United States Patent [19]

Stumpp et al.

[11] 4,340,181

[45] Jul. 20, 1982

[54] FUEL INJECTION NOZZLE FOR INTERNAL COMBUSTION ENGINES

[75] Inventors: Gerhard Stumpp; Ewald Eblen, both of Stuttgart; Karl Hofmann, Remseck; Néstor R. Amaya, Stuttgart; Josef Schlagenhauf, Esslingen; Odon Kopše, Stuttgart, all of Fed. Rep. of Germany

[73] Assignee: Robert Bosch GmbH, Stuttgart, Fed. Rep. of Germany

[21] Appl. No.: 149,365

[22] Filed: May 13, 1980

[30] Foreign Application Priority Data

Jun. 22, 1979 [DE] Fed. Rep. of Germany ..... 2925187

[51] Int. Cl.[3] ..... B05B 1/32

[52] U.S. Cl. ..... 239/533.3; 123/612

[58] Field of Search ..... 239/533.2, 533.3, 533.4, 239/533.5, 533.6, 533.7, 533.8, 533.9, 533.11, 533.12, 73; 137/509, 554; 123/612, 472

[56] References Cited

U.S. PATENT DOCUMENTS

| | | | |
|---|---|---|---|
| 3,361,353 | 1/1968 | Millman | 239/533.2 X |
| 4,066,059 | 1/1978 | Mayer et al. | 123/650 X |
| 4,183,467 | 1/1980 | Shearton et al. | 239/533.3 X |
| 4,231,525 | 11/1980 | Palma | 239/585 |

*Primary Examiner*—Robert B. Reeves
*Assistant Examiner*—Gene A. Church
*Attorney, Agent, or Firm*—Edwin E. Greigg

[57] ABSTRACT

A fuel injection nozzle for internal combustion engines, in which the valve needle together with the valve seat of the nozzle body forms an electric switch which by its opening and closing indicates the injection onset and the injection duration. A spring-elastic conductive element is disposed inside the closing spring and connects the attachment piece with the valve needle.

10 Claims, 2 Drawing Figures

FUEL INJECTION NOZZLE FOR INTERNAL COMBUSTION ENGINES

BACKGROUND OF THE INVENTION

The invention relates to a fuel injection nozzle for internal combustion engines. An injection nozzle of this kind is already known from German laid-open application No. 27 39 628, in which the attachment piece is attached to a measuring device, in order to ascertain the electric resistance between the nozzle needle and the valve seat and to indicate the movement of the nozzle needle relative to the valve seat. In this nozzle, the valve seat is connected to ground and the nozzle needle is connected to the positive pole of the vehicle electrical system, and connecting the attachment piece electrically to the nozzle needle is accomplished via the compression body and the closing spring. While a connection of this kind requires few structural parts, in practice it does not satisty all the requirements made upon it, because the fuel film between the parts is utilized as a means of insulation.

OBJECTS AND SUMMARY OF THE INVENTION

The fuel injection nozzle for internal combustion engines according to the invention has the advantage over the above-discussed prior art in that the electrical connection between the nozzle needle and the attachment piece is effected in a reliable manner and that mass-produced elements can be embodied, without excessive difficulty, as electric switches without the fuel acting to insulate the switch.

As a result of the characteristics disclosed herein, advantageous further embodiments of and improvements to the fuel injection nozzle are possible. In one embodiment of the injection nozzle, an element produced according to industrial norms (that is, a standard element) is used as the conductive element. In the embodiment, a reliably functioning, releasable contact is effected between the attachment piece and the contact element. The modification of the injection nozzle assures reliable contact of the conductive element at the compression element, even under difficult operating conditions.

With the embodiment of the injection nozzle, an insulation of the nozzle needle from the nozzle body is attained which is favorable from a manufacturing standpoint. The same effect can be attained between the compression spring and the compression member with the modification of the injection nozzle.

The invention will be better understood and further objects and advantages thereof will become more apparent from the ensuing detailed description of preferred embodiments taken in conjunction with the drawings.

DESCRIPTION OF THE EXEMPLARY EMBODIMENTS

Figure 1:
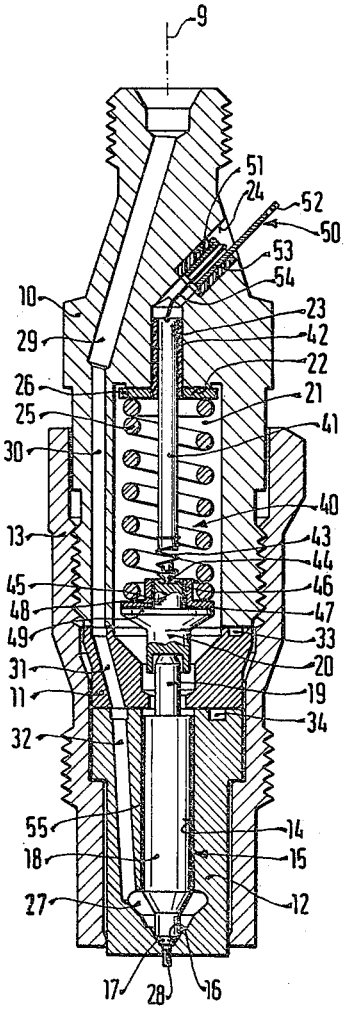
FIG. 1, in axial cross-section and on an enlarged scale, shows the first exemplary embodiment of the invention.
Figure 2:
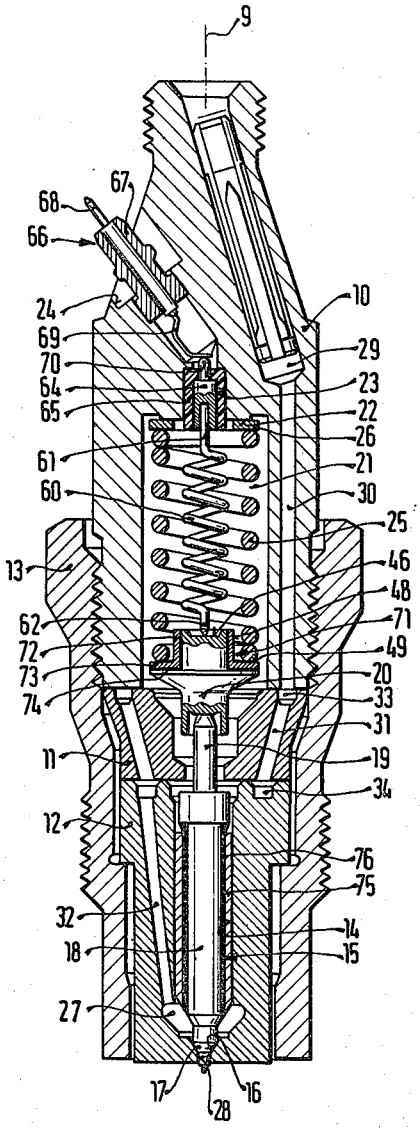
FIG. 2, again in axial cross-section and on an enlarged scaled, shows the second exemplary embodiment of the invention.

The two fuel injection valves for internal combustion engines shown in FIGS. 1 and 2 are manufactured substantially of electrically conductive materials and are rotationally symmetrical relative to the valve axis 9. Both injection valves substantially comprise a nozzle holder 10, an immediately adjacent intermediate plate 11 and a nozzle body 12, which are axially screwed together by means of an overthrust nut 13.

A valve needle 15 has a needle shaft 18 which slides in a guide bore 14 of the nozzle body 12, a sealing cone 17 cooperating with a valve seat 16 of the nozzle body 12, and a compression stub element 19 which is in constant contact with a compression member 20 which includes an integral upper portion 45 as will be explained later herein.

A spring chamber 21 open on one end face and having a shoulder 22 and a bore 23 is cut out of the nozzle holder 10, with a continuation thereof leading to the outside in the form of a recess 24. A helical compression spring 25 is supported on one end, via a spring-adjustment plate 26, on the shoulder 22 and on the other end, via an insulation means to be described below, on the compression member 20. The fuel proceeds through inlet channels 29–32 and annular channels 33, 34 into a compression chamber 27 of the nozzle body 12, which communicates via the valve seat 16 with an injection port 28.

In FIG. 1, a conductive element 40 manufactured of electrically conductive material has a contact pin 41 secured in the bore 23 by means of an insulating sheath 42, a contact spring 43 clamped to the end portion of the contact pin 41, and a contact cone 44 snapped into the lower end of the contact spring 43. The contact cone 44 rests in a form-fitting manner in an indentation 46 of a compression member 45, so that a durable electrical contact is established between the two elements. A guide face 48 and a contact face 49 of the compression member 20 have an insulation coating 47 of abrasion-resistant material, so that the compression spring 25 is insulated electrically from the compression member 20.

An attachment piece 50 is secured via an insulating sheath 51 in the recess 24 of the nozzle holder 10. The contact tongue 52 of this attachment piece 50 receives a line (not shown) of a test appliance and the end portion of a connecting line 54 is soldered into the eye 53 of the tongue 52; likewise, the other end portion of this connecting line 54 is connected to the contact pin 41. The needle shaft 18 of the valve needle 15 has an insulating coating 55 of abrasion-resistant material which slides within the guide bore 14 of the nozzle body 12.

The injection valve is threaded into the engine block (not shown) in its functional state and accordingly is in electrically conductive contact with the ground of the vehicle electrical system. In the illustrated closed state, the electric switch embodied by the valve seat 16 and the sealing cone 17 is closed, as a result of which a circuit of electric current between the nozzle body 12 and the test applicance, not shown, is also closed.

In the opened state of the injection nozzle, the electric switch 16/17 is opened, and because the valve needle 15, the compression member 20, the contact pin 41 and the attachment piece 50 are electrically insulated from the nozzle body 12 and the nozzle holder 10, the electrical current path now opens, and thus it interrupts the electrical connection between the engine block and the test appliance.

The conductive element 60 of the injection valve shown in FIG. 2 is embodied as a helical spring having two axial ends 61, 62 and is disposed freely movably inside the compression spring 25. The end 62 is supported in a force-locking manner in the indentation 46 of the compression bolt 20, and the other end 61 is disposed in a contact member 64, which is fixed by means of an insulating cap 65 in the bore 23.

The attachment piece 66 is secured via a sheath 67 in the recess 24 of the nozzle holder 10, the plug 68 of which, insulated with respect to the sheath 67, exits in the form of a contact tongue 69, which is in force-locking contact with a stub-means 70 of the contact member 64 and accordingly establishes an electrical connection.

A sheath 71 of tempered steel, comprising a ring 72 and a collar 73, is made to adhere by means of an electrically insulating plastic coating 74 to the compression member 20 and embodies the guide face 48 and the contact face 49 for the compression spring 25. A sheath 75 of tempered steel is made to adhere by means of an insulating coating 76 to the needle shaft 18 of the valve needle 15 and slides in the guide bore 14 of the nozzle body 12.

In this second exemplary embodiment as well, the sealing cone 17 and the valve seat 16 comprise the electric switch, and the elements connected to one another between the sealing cone 17 and the plug 68 are insulated electrically from the housing portions with which they cooperate, so that the path for electrical current between the valve seat 16 and the test appliance, not shown, is likewise opened and closed as the injection valve is opened and closed.

The foregoing relates to preferred exemplary embodiments of the invention, it being understood that other embodiments and variants thereof are possible within the spirit and scope of the invention, the latter being defined by the appended claims.

What is claimed and desired to be secured by Letters Patent of the United States is:

1. A fuel injection nozzle for internal combustion engines having a valve seat in a nozzle body of electrically conductive material, a valve needle of electrically conductive material arranged to be lifted from the valve seat as a result of the pressure of the fuel and counter to the force of a first compression spring said valve seat forming an electric switch with said valve needle; a compression member arranged between the compression spring and said valve needle and held against said valve needle by a compression force of said first compression spring, a bore in said nozzle body, a spring-elastic conductive element coaxially disposed within said compression spring and conductively connected to said compression member and said valve needle through said compression member, an insulated electrical attachment piece secured in said bore and conductively connected to said spring-elastic conductive element, characterized in that the connection of said spring-elastic conductive element to said valve needle forms an axially spring-elastic conductive element inside said compression spring and that said spring-elastic conductive element has one end which is connected unreleasably to said attachment piece while an other end is in force-locking contact with said compression member.

2. An injection nozzle as defined by claim 1, characterized in that said spring elastic conductive element is embodied as a second compression spring having two axially directed end portions and that one of said portions is inserted in a contact member disposed in said nozzle holder, said contact member arranged to cooperate with said attachment piece.

3. An injection nozzle as defined by claim 2, characterized in that said attachment piece is secured in said nozzle holder in an insulated manner, said attachment piece further including a contact tongue arranged to rest on the contact member.

4. An injection nozzle as defined by claim 1, characterized in that said spring elastic conductive element comprises a contact pin insulated from said nozzle holder, said contact pin further including a contact spring and a dependent contact zone.

5. An injection nozzle as defined by claim 1, characterized in that said valve needle has an insulating coating, preferably of abrasion-resistant material.

6. An injection nozzle as defined by claim 1, characterized in that said nozzle body is provided with a guide bore for said value needle and said guide bore is coated with an abrasion resistant material.

7. An injection nozzle as defined by claim 1, characterized in that said nozzle body includes a bore for said valve needle and a steel sheath in said bore.

8. An injection nozzle as defined by claim 1, characterized in that said first compression member has a contact face and a guide face for said compression spring and that both said faces are coated with an insulation, preferably of abrasion-resistant plastic.

9. An injection nozzle as defined by claim 1, characterized in that said compression member includes an annular shoulder for supporting said compression spring and a sheath interposed between said member and said spring.

10. An injection nozzle as defined by claim 1, characterized in that said sheath is secured to said compression member by an insulating plastic coating.

* * * * *